United States Patent [19]

Ninomiya et al.

[11] Patent Number: 4,503,824

[45] Date of Patent: Mar. 12, 1985

[54] METHOD AND APPARATUS FOR CONTROLLING AIR-FUEL RATIO IN AN INTERNAL COMBUSTION ENGINE

[75] Inventors: Masakazu Ninomiya; Atsushi Suzuki, both of Kariya; Yutaka Kawashima, Okazaki, all of Japan

[73] Assignee: Nippondenso Co., Ltd., Kariya, Japan

[21] Appl. No.: 576,773

[22] Filed: Feb. 3, 1984

Related U.S. Application Data

[63] Continuation of Ser. No. 298,735, Sep. 2, 1981.

[30] Foreign Application Priority Data

Sep. 5, 1980 [JP] Japan ..... 55-122245

[51] Int. Cl.[3] ..... F02B 3/00; F02P 5/04

[52] U.S. Cl. ..... 123/436; 123/435; 123/419; 123/443

[58] Field of Search ..... 123/435, 436, 443, 440, 123/425, 419

[56] References Cited

U.S. PATENT DOCUMENTS

| | | | |
|---|---|---|---|
| 2,842,108 | 7/1958 | Sanders | 123/436 |
| 3,596,643 | 8/1971 | Schweitzer | 123/436 |
| 4,026,251 | 5/1977 | Schweitzer et al. | 123/436 |
| 4,138,979 | 2/1979 | Taplin | 123/436 |
| 4,305,364 | 12/1981 | Stuckas | 123/440 |

*Primary Examiner*—Ronald B. Cox

*Attorney, Agent, or Firm*—Kenyon & Kenyon

[57] ABSTRACT

A method for controlling the air-fuel ratio in an internal combustion engine in which the correction of a base air-fuel ratio is carried out on the basis of the determination as to whether the base air-fuel ratio is on the richer or the leaner side of the air-fuel ratio corresponding to optimum specific fuel consumption, the determination being carried out by comparing four driving state indicating signals at different air-fuel ratios with each other, the correction being directed to bringing the base air-fuel ratio closer to the air-fuel ratio corresponding to the optimum specific fuel consumption.

15 Claims, 10 Drawing Figures

Fig. 4

MAP STORED IN MEMORY

| P \ N | - - - | - - - | r−2 | r−1 | r | r+1 | r+2 | - - - | - - - |
|---|---|---|---|---|---|---|---|---|---|
| ⋮ | | | | | | | | | |
| ⋮ | | | | | | | | | |
| p−1 | | | T(p-1,r-2) | T(p-1,r-1) | T(p-1, r ) | T(p-1,r+1) | T(p-1,r+2) | | |
| p | | | T(p,r-2) | T(p,r-1) | T( p , r) | T(p,r+1) | T(p,r+2) | | |
| p+1 | | | T(p+1,r-2) | T(p+1,r-1) | T(p+1, r ) | T(p+1,r+1) | T(p+1,r+2) | | |
| ⋮ | | | | | | | | | |
| ⋮ | | | | | | | | | |

METHOD AND APPARATUS FOR CONTROLLING AIR-FUEL RATIO IN AN INTERNAL COMBUSTION ENGINE

This is a continuation of application Ser. No. 298,735, filed Sept. 2, 1981.

BACKGROUND OF THE INVENTION

The present invention relates to a method and an apparatus for controlling the air-fuel ratio in an internal combustion engine.

In general, the air-fuel ratio in an internal combustion engine of a motor car in the ordinary running state is selected to be equal to or less than the stoichiometrical air-fuel ratio, in the accelerating at wide open throttle and in the hill climbing states to be equal to the value, approximately 13, corresponding to the maximum output of the engine, and in the idling state to be equal to the value chosen from the viewpoint of the stability of the engine.

In the prior art, for air-fuel ratio control in the ordinary running state, an open loop control of the carburetor is used in which some increase in specific fuel consumption occurs due to variation in manufactured engines, variation in the operation characteristic of an engine over time, and manufacturing variation in carburetors. In an electronically controlled fuel injection device, in which the volume of the intake air is measured by an intake air volume sensor and the like, the required amount of fuel is calculated by a computer device and the fuel is injected into the air intake manifold by an electromagnetic valve in accordance with the calculated required amount, a closed loop control is used in practice to maintain a stoichiometrical air-fuel ratio (approximately 15) by means of an oxygen concentration sensor in the exhaust duct. Also, closed loop control of a carburetor is used in practice for some kinds of engines, in which the amount of air-bleeding is modified of the stoichiometrical air-fuel ratio by the oxygen concentration sensor. Although these closed loop control systems can reduce the variation in the air-fuel ratio, these closed loop control systems involve a problem of incurring waste in the fuel consumption because the theoretical stoichiometric air-fuel ratio is not the air-fuel ratio for the best specific fuel consumption.

A prior art control method has been proposed in which the above described fuel consumption increase is prevented and optimum specific fuel consumption is attained. In this method, air which by-passes the carburetor is caused to dither, i.e. the air-fuel ratio is varied with a predetermined frequency to the richer and leaner side alternately, hence the direction of the air-fuel ratio which attains an improvement of the specific fuel consumption is determined, and thereby the air-fuel ratio is corrected by a subsidiary air valve which by-passes the carburetor. In this method, the engine runs for one period at an air-fuel ratio on the relatively richer side and for one period at another air-fuel ratio on the relatively leaner side, and the rotation rate $N_{er}$ while running under the richer side air-fuel ratio is compared with the rotation rate $N_{el}$ while running under the leaner side air-fuel ratio. The engine is controlled in such a manner that, if $N_{er}>N_{el}$, the amount of the by-passing air is decreased, while if $N_{er}>N_{el}$, the amount of the by-passing air is increased.

In the above described prior art control method, however, it is impossible to determine whether the variation of the rotation rate is caused by the variation of the air-fuel ratio or is caused by external factors such as accelerator action, ascending a slope, or descending a slope, if the change of the output of the engine is measured by the change of the rotation rate. Accordingly, there is a problem in this method that the control may be carried out in the direction opposite to the correct direction to improve the specific fuel consumption and thereby the specific fuel consumption may be deteriorated. Also, there is a difficulty in obtaining a subsidiary air valve, as used by this prior art system as the means for correcting the air-fuel ratio, which is capable of changing the flow area with high precision.

It is the main object of the present invention to provide an improved method for controlling the air-fuel ratio in an internal combustion enging in which the control is carried out in order to ensure that the specific fuel consumption in the internal combustion engine is maintained always as close to the optimum value as possible.

SUMMARY OF THE INVENTION

In accordance with an aspect of the present invention, there is provided a method for controlling the air-fuel ratio in an internal combustion engine, which comprises the steps: obtaining the base air-fuel ratio, detecting the signals which represent the status of the engine in operation, selecting the air-fuel ratio at the richer side of the base air-fuel ratio and the air-fuel ratio at the leaner side of the base air-fuel ratio in the vicinity of the base air-fuel ratio, driving the engine using an air-fuel mixture with said selected at least two air-fuel ratios in the richer and the leaner side during predetermined periods, detecting the signals which represent the status of engine during said predetermined periods, comparing at least three said detected signals, determining, based on the result of said comparison, whether the air-fuel ratio is the value in the richer or the leaner side of the air-fuel ratio corresponding to the best fuel consumption, and; correcting, based on the result of said determination, the base air-fuel ratio so as to become closer to the air-fuel ratio corresponding to the maximum specific fuel consumption.

In accordance with another aspect of the present invention, there is provided an apparatus for controlling the air-fuel ratio in an internal combustion engine comprising: means for varying the air-fuel ratio by varying the amount of the fuel injection of the fuel injection valve, sensors provided in the system of the internal combustion engine for detecting the operation conditions of the internal combustion engine, a computer for receiving the signals from said sensors, determining the state of the air-fuel ratio and producing the signals which are supplied to the fuel injection valve and the electromagnetic valve in the by-pass for the main air path, and; means for regulating the air-fuel ratio of the air-fuel mixture fed to the engine, wherein the determination as to whether the base air-fuel ratio is the value in the richer side or in the leaner side of the air-fuel ratio corresponding to the best fuel consumption, and the correction, based on the result of said determination, of the base air-fuel ratio so as to become closer to the air-fuel ratio corresponding to the best fuel consumption are carried out in said computer.

BRIEF DESCRIPTION OF THE DRAWINGS

FIG. 4 illustrates a map stored in the memory in the computer regarding the correction pulse width.

DETAILED DESCRIPTION OF THE PREFERRED EMBODIMENTS

Figure 1A:
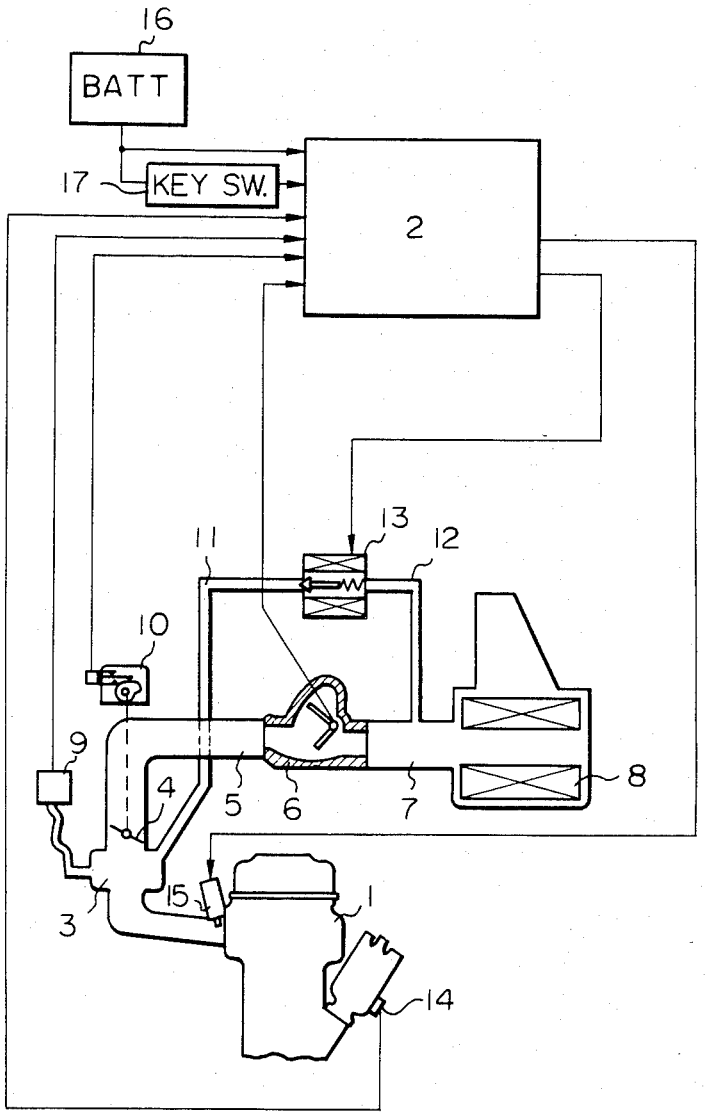
FIG. 1A illustrates an apparatus used for the method for controlling the air-fuel ratio in an internal combustion engine as an embodiment of the present invention.

An apparatus used for controlling the air-fuel ratio in an internal combustion engine as an embodiment of the present invention is illustrated in FIG. 1A. The apparatus of FIG. 1A comprises an internal combustion engine 1, a rotational angle sensor 14 incorporated with a distributor, an intake manifold 3, a throttle valve 4 actuated by an accelerator 10, and an air flow rate sensor 6. The air flow rate sensor 6 is of the type to determine the flow rate of the air by measuring output voltage corresponding to the angle of the obstructive plate which is located in the air flow path and which changes its angle in accordance with air flow rate. The apparatus of FIG. 1A comprises also an air-transmitting down-stream duct 5 connecting the air flow rate sensor 6 with the throttle valve 4, an air cleaner 8, an air-transmitting up-stream duct 7 connecting the air cleaner 8 with the air flow rate sensor 6, a pressure sensor 9 for sensing air pressure, a throttle sensor 10 for detecting the fully-closed state and the more than 60% open state of the throttle valve 4, an electromagnetic valve 13 for regulating air flow through a by-pass for the air flow rate sensor 6 and the throttle valve 4, a by-pass air-transmitting down-stream duct 11 connecting the electromagnetic valve 13 with the air intake manifold 3, a by-pass air transmitting up-stream duct 12 connecting the air-transmitting up-stream duct 7 with the electromagnetic valve 13 and a computer unit 2.

The electromagnetic valve 13 is of the ON-OFF type which acts at only either the OPEN or CLOSED position. The computer unit receives signals from the air flow rate sensor 6, the rotational angle sensor 14 and the throttle sensor 10, calculates the amount of the fuel injection at the time in question as a pulse width, and produces an output signal to be supplied to the fuel injection valve 15.

Figure 1B:
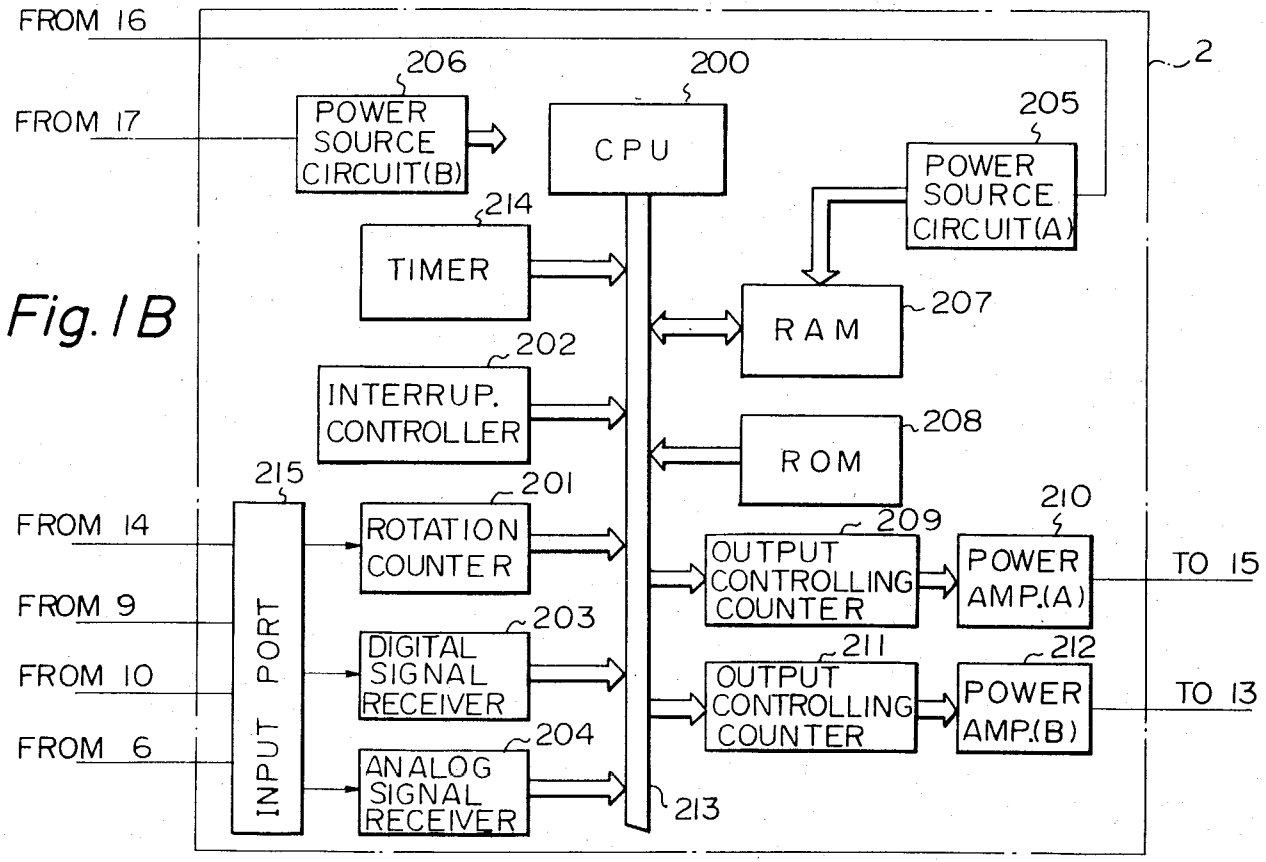
FIG. 1B illustrates the structure of the computer in the apparatus of FIG. 1A.

The structure of the computer unit 2 is illustrated in FIG. 1B. The computer unit 2 comprises a central processor unit (CPU) 200, a common bus 213, a timer 214, an interruption controlling portion 202, a rotation counter 201, a digital signal receiver 203, an analog signal receiver 204, an input port 215 receiving signals of the rotational angle sensor 14, the pressure sensor 9, the throttle sensor 10 and the air flow rate sensor 6, a random access memory 207, a read only memory 208, a counter 209 for controlling the timer for the fuel injection, a power amplifier (A) 210 for producing the signal for driving the fuel injection valve 15, an output control portion 211 for determining the signal for the electromagnetic valve 13 in the by-pass route 11 and 12 and a power amplifier (B) 212 for producing the signal for driving the electromagnetic valve 13. The power source circuits 205 and 206 receive power from the battery 16 and supply power to the random access memory 207 and other elements of the computer unit 2. The key switch 17 is provided between the battery 16 and the power source circuit 206.

Figure 2:
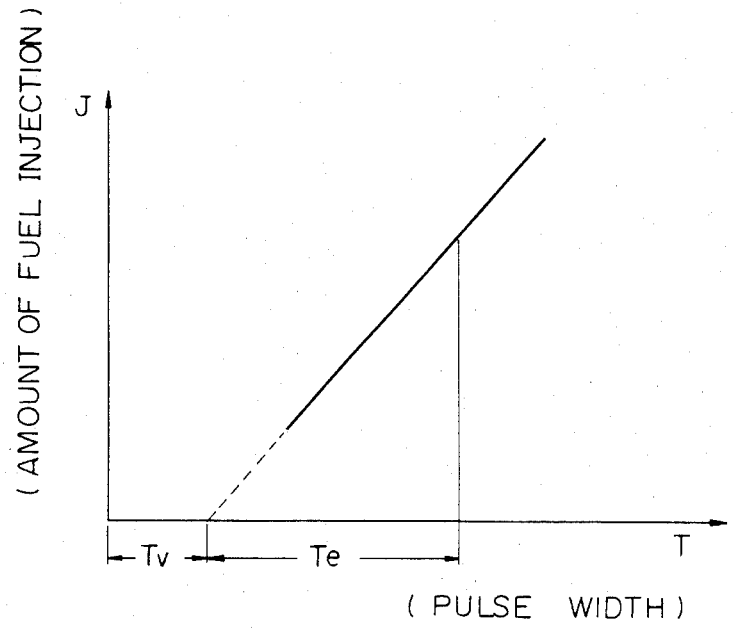
FIG. 2 illustrates the relationship between the pulse width and the amount of the injected fuel.

The relationship between the pulse width T and the amount of the injected fuel J in the electromagnetic fuel injection valve 15 by which the fuel under a predetermined pressure is intermittently injected in accordance with the width of the applied pulse is illustrated in FIG. 2. As the width T of the pulse produced from the computer 2 increases, the amount of the injected fuel increases linearly. $T_v$ is the pulse width corresponding to the delay time of the opening and the closing of the fuel injection. $T_e$ is the effective range of the width of the pulse for controlling the fuel injection valve.

Figure 3A:
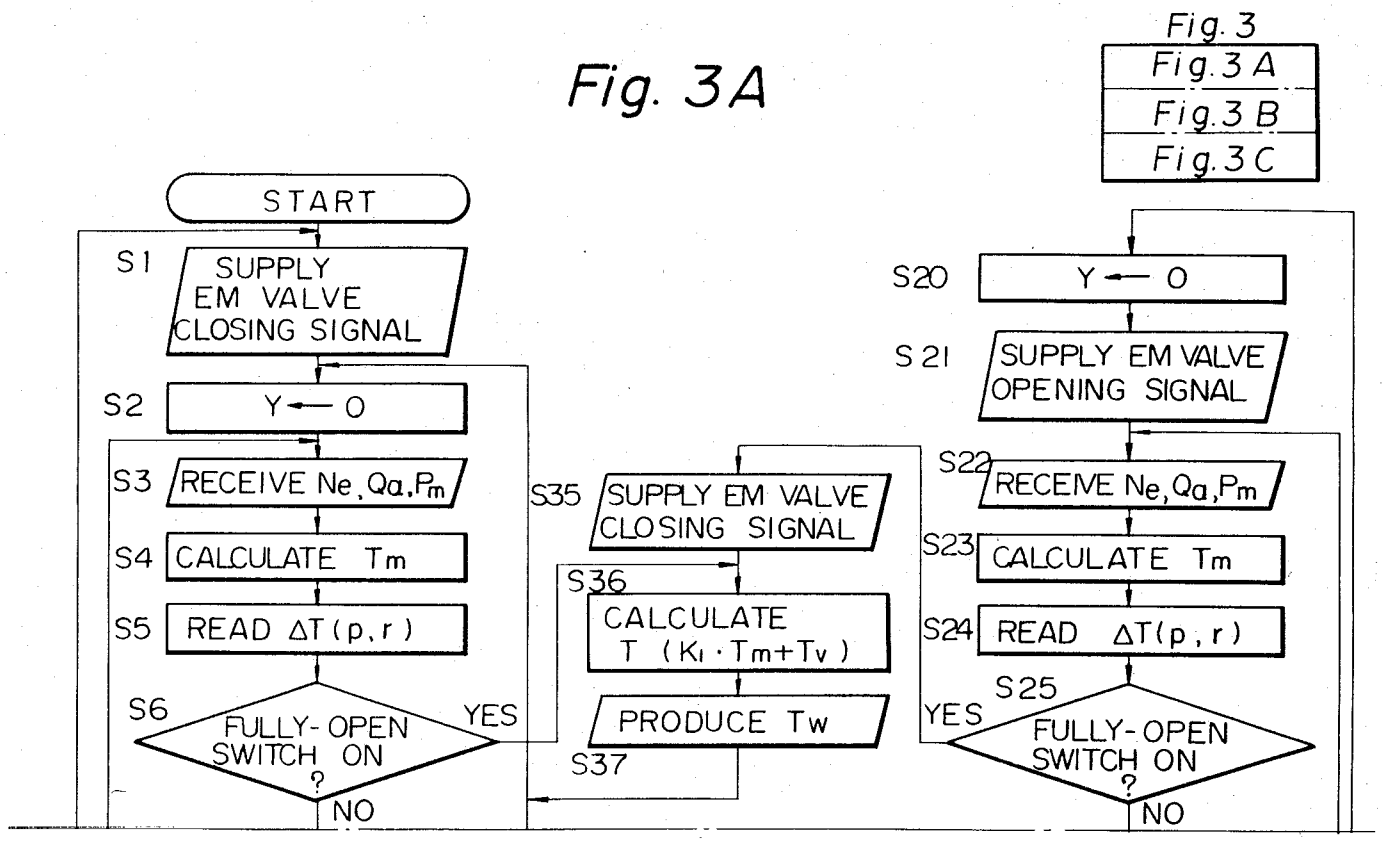
FIGS. 3A-3C show the flow chart which illustrates an example of the calculation process in the computer in the apparatus of FIG. 1A.
Figure 3B:
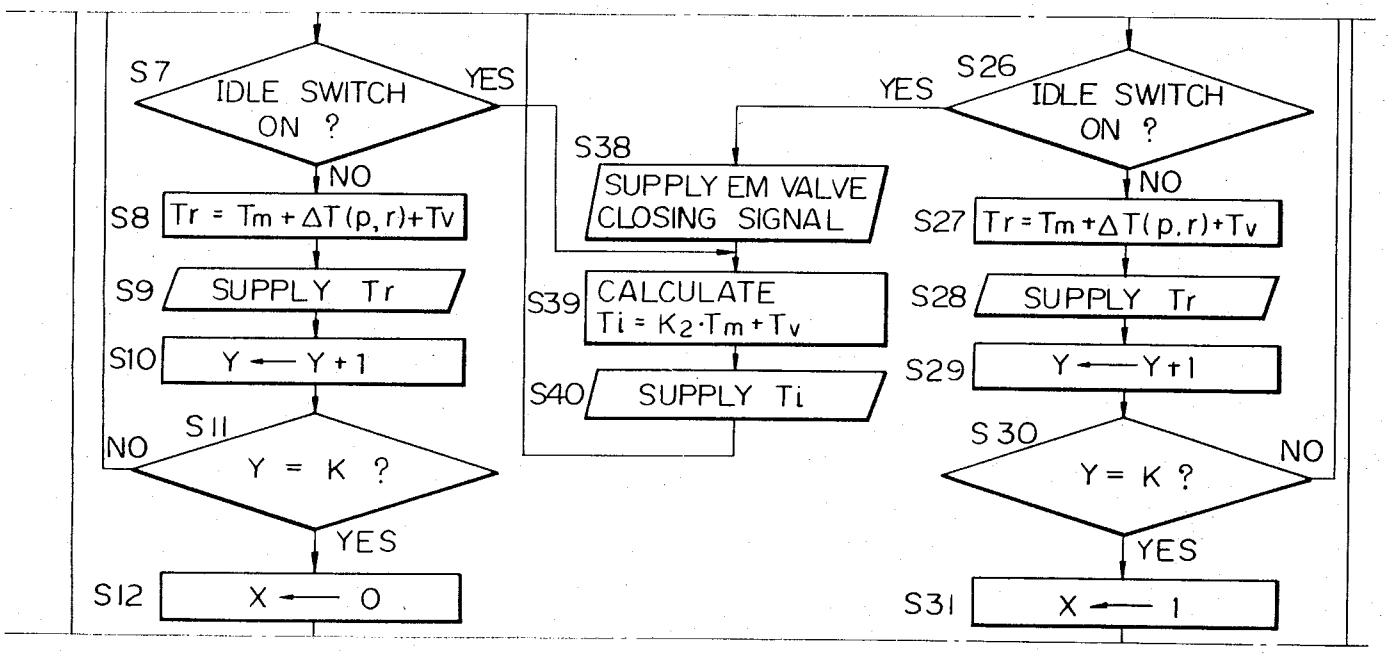
Figure 3C:
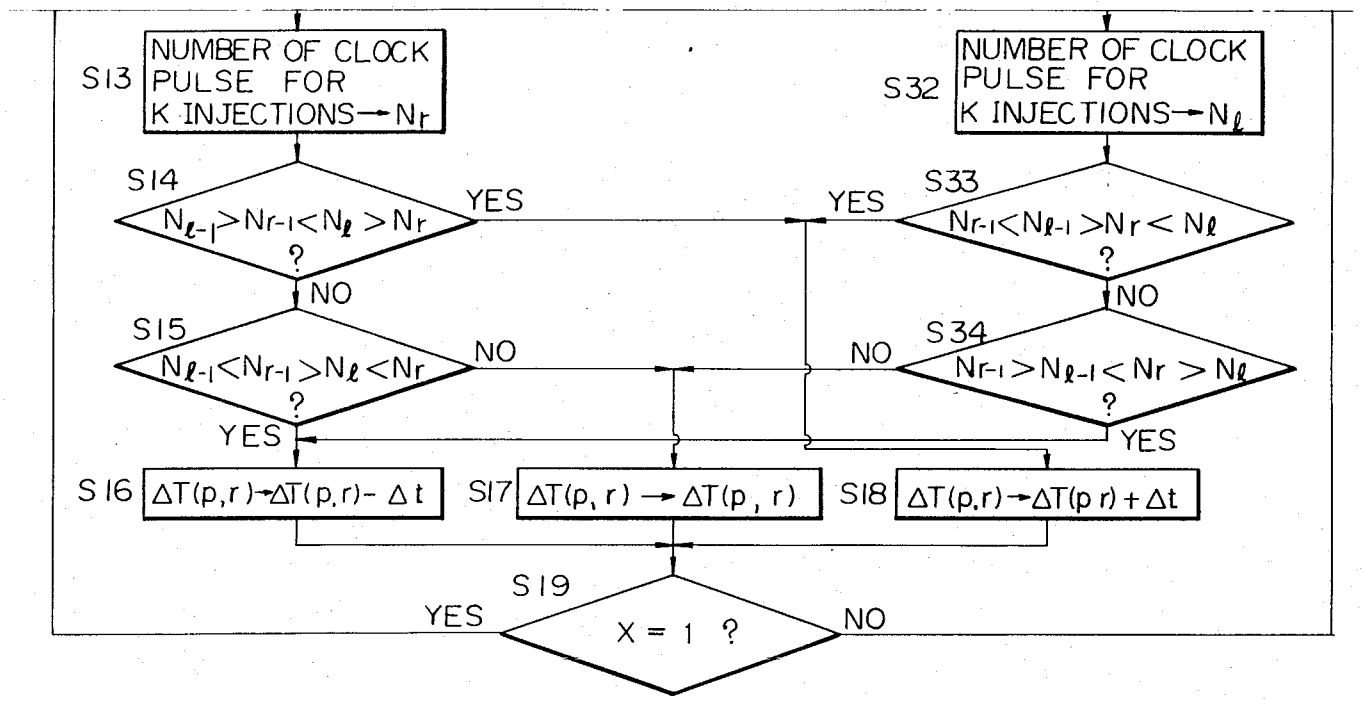

The flow chart of an example of the calculation process in the computer 2 is illustrated in FIG. 3. When the engine 1 is started, the calculation process is started from Step S1 in which the by-pass electromagnetic valve 13 is caused to be closed. In Step S2, the initialization of the counter Y for counting the number of injection is carried out ($Y \leftarrow 0$). The injection occurs once per each rotation at a predetermined crank angle in a four-cylinder engine. The integrated number of rotations is obtained by counting the number of injections.

In Step S3, the rotational speed $N_e$, the amount of the intake air $Q_a$ and the intake air pressure $P_m$ are introduced by the rotational angle sensor 14, the air flow rate sensor 6 and the air pressure sensor 9. In Step S4, the calculation of the main pulse width, taking the stoichiometrical air-fuel ratio ($A/F=14.7$) as the base value, using the rotational speed $N_e$ and the amount of the intake air $Q_a$ is carried out. In Step S5, the correction pulse width $\Delta T(p, r)$ corresponding to the present rotational speed $N_e$ and the present intake air pressure $P_m$ is read from a map, as illustrated in FIG. 4, stored in the memory. In the map illustrated in FIG. 4, the value of the rotational speed $N_e$ and the value of the intake air pressure $P_m$ are divided into sections with predetermined intervals, and a value of the correction pulse width $\Delta T(p, r)$ is assigned to each of the combinations of the values $N_e$ and $P_m$.

In Step S6, the decision by the throttle sensor 10 as to whether or not the opening of the throttle valve is greater than 60%, i.e. whether or not the fully-open detection switch is ON, is carried out. When the opening of throttle valve is greater than 60%, the process proceeds to Step S36. In Step S36, the main pulse width $T_m$ is multiplied by a correction coefficient $K_1$ for obtaining the running air-fuel ratio (approximately equal to 13) and to the product is added the delay time $T_v$ of the opening action of the fuel injection valve, as indicated in FIG. 2 which illustrates the relationship between the pulse width and the amount of the fuel injection. Thus, when the opening of the throttle valve is greater than 60%, the pulse width is represented by the following equation $$T_w = K_1 \cdot T_m + T_v$$

In Step S37, the signal of the pulse width $T_w$ is supplied to the fuel injection valve 15, and the process returns to Step S2. Thus, when the opening of the throttle valve is greater than 60%, no decision and correction regarding the air-fuel ratio for best fuel consumption is carried out.

In Step S6, when the opening of the throttle valve is less than 60%, the decision is NO and the process proceeds to Step S7. In Step S7, the decision is made as to whether or not the angle of the throttle valve provides the fully-closed state, i.e. whether or not the idle switch is ON. When the throttle valve is in fully-closed state, the decision is YES, and the process proceeds to Step S39. In Step S39, the main pulse width $T_m$ calculated in Step S4 is multiplied by a correction coefficient $K_2$ and to the product of the multiplication is added the delay time $T_v$. Thus, in the case of when the engine is idling, the pulse width $T_i$ is represented by the following equation.

$$T_i = K_2 \cdot T_m + T_v$$

In Step S40, the signal of the pulse width $T_i$ is supplied to the fuel injection valve 15, and the process returns to Step S2. Thus, in the case of idling, no decision and correction is made regarding the air-fuel ratio for best fuel consumption, as in the case where the opening of the throttle valve is greater than 60%.

In Step S7, when the opening of the throttle valve is not in the idling state, the decision is NO, and the process proceeds to Step S8. In Step S8, the final pulse width $T_r$ is obtained by summing the main pulse width $T_m$, the correction pulse width $\Delta T(p, r)$ and $T_v$. In Step S9, the signal of the pulse width $T_r$ is supplied to the fuel injection valve 15.

In Step S10, the number Y of the fuel injections is incremented by one. In Step S11, the decision continues to be NO until the number Y is incremented up to a preselected value K while the process is proceeding in the loop consisting of the routine S3 through S11. In Step S12, the number Y of the fuel injections is made zero. In Step S13, the counted number $N_r$ of the clock pulses for K times injections, i.e. the period of the rotations for K times injections, is stored in the memory.

Figure 5:
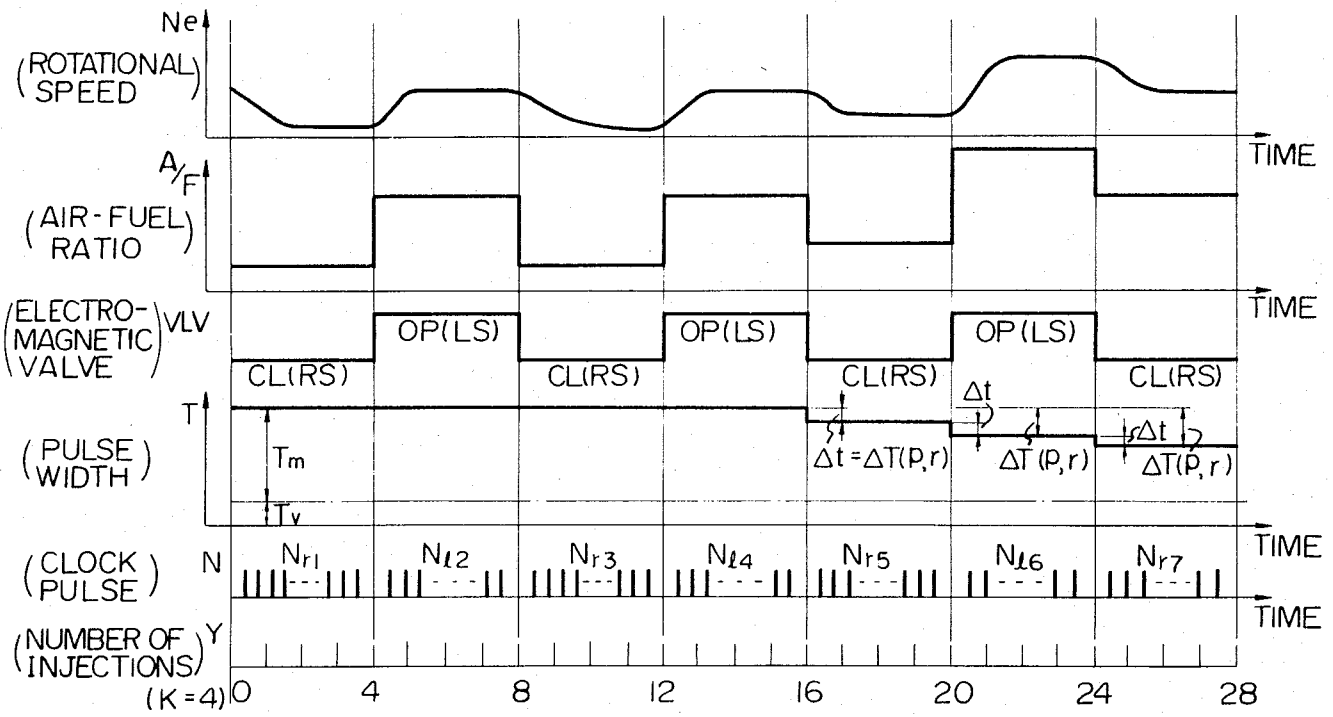
FIG. 5 illustrates a time chart of the change of signals in the process of the calculation conducted by the computer.

The change of signals in the above described process of the calculation is illustrated in the time chart of FIG. 5. In FIG. 5, the changes of the rotational speed $N_e$, the air-fuel ratio A/F, the state VLV of the by-pass electromagnetic valve, the pulse width, the clock pulses and the number of the fuel injections are illustrated. The process is in the rich period (RS) while the by-pass electromagnetic valve is in the closed state (CL), and is in the lean period (LS) while the by-pass electromagnetic valve is in the open state (OP). The number K of the fuel injection is preselected as four (K=4). The engine is operated with the by-pass electromagnetic valve closed, the number of the clock pulses being equal to $N_{r1}$.

Figure 6:
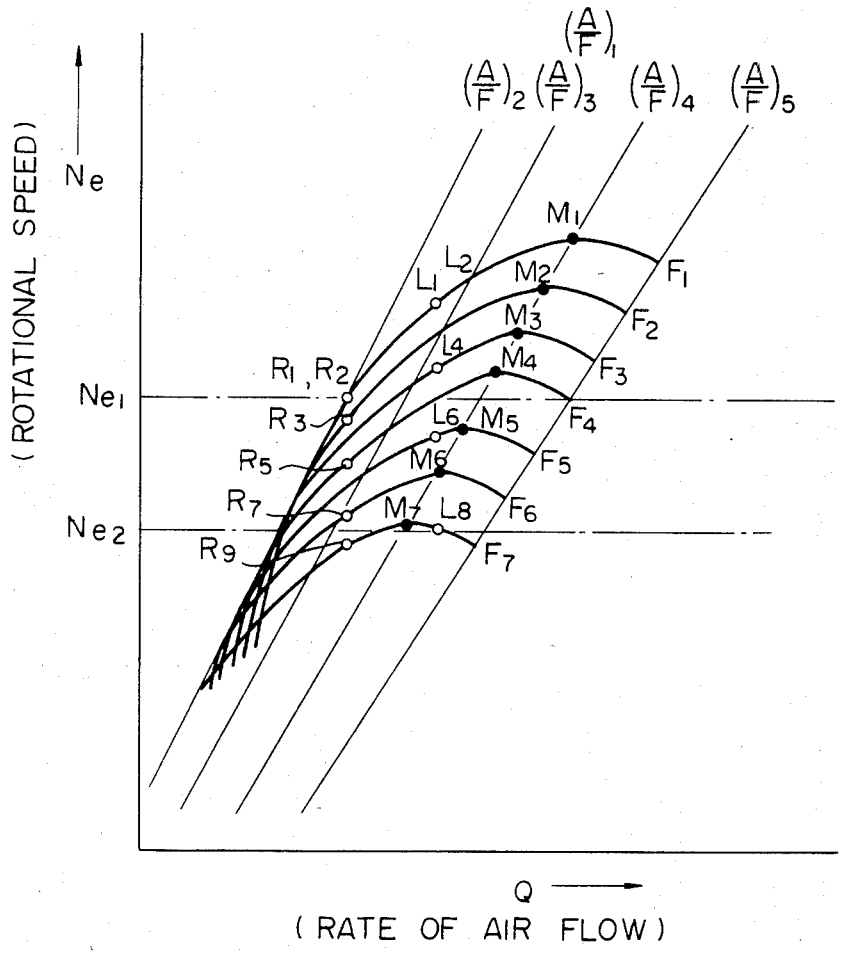
FIG. 6 illustrates a graph of the relationship between the rate of the air flow and the rotational speed using the air-fuel ratios and the rates of the fuel flow as the parameters.

The above described state of the operation of the engine corresponds to the position $R_1$ of the graph of FIG. 6 which illustrates the relationship between the rate Q of the air flow and the rotational speed $N_e$ of the engine under the condition that the axial torque of the engine is constant.

In FIG. 6, $F_1$, $F_2$, $F_3$, $F_4$, $F_5$, $F_6$ and $F_7$ represent the rates of the fuel flow, where $F_1 > F_2 > F_3 > F_4 > F_5 > F_6 > F_7$. Each of the curves identified by $F_1$ through $F_7$ represents the change of $N_e$ in accordance with the change of Q under one of the values $F_1$ through $F_7$. $(A/F)_1$, $(A/F)_2$, $(A/F)_3$, $(A/F)_4$ and $(A/F)_5$ represent the air-fuel ratios. Each of the straight lines identified by $(A/F)_1$ through $(A/F)_5$ represents the change of $N_e$ in accordance with the change of Q under one of the values $(A/F)_1$ through $(A/F)_5$. Usually, the rotational speed becomes the maximum value when the air-fuel ratio is approximately equal to 13 under the condition that the rate of the flow of the air-fuel mixture is constant. In FIG. 6, $(A/F)_2$ is equal to 13. The positions $M_1$, $M_2$, $M_3$, $M_4$, $M_5$, $M_6$ and $M_7$, at which $N_e$ attains the maximum value in each of the curves identified by $F_1$ through $F_7$, are on the straight line identified by $(A/F)_4$. The specific fuel consumption becomes optimum at the positions $M_1$, $M_2$, $M_3$, $M_4$, $M_5$, $M_6$ and $M_7$ for each of the rates of the fuel flow $F_1$ through $F_7$. It is desired in the present invention to conduct the automatic control for operating the engine at the positions $M_1$ through $M_7$.

For example, when the engine is running with the rotational speed $N_{e1}$, and the initial state is at $R_1$ on the curve identified by $F_1$, running with the optimum specific fuel consumption is attained at the middle of $M_4$ and $M_5$ i.e. at the middle of the rates $F_4$ and $F_5$ of the fuel flow.

In Step S14 and S15, the four rotational periods $N_{l-1}$, $N_{r-1}$, $N_l$ and $N_r$ in which the present rich step rotational period $N_r$ is included are compared with each other. $N_l$ is the preceding lean step rotational period, $N_{r-1}$ is the next preceding rich step rotational period, and $N_{l-1}$ is the further next preceding lean step rotational period.

When the existence of the relationship $N_{l-1} > N_{r-1} < N_l > N_r$ is acknowledged in Step S14, the decision is YES, and the process proceeds to S18. This means that, if the rotational speed increases in the rich step and decreases in the lean step, an increase in the amount of the fuel injection will cause the rotational speed and the specific fuel consumption to increase.

In Steps S17 and S18, the calculation of the correction $\Delta T(p, r)$ of the pulse width is carried out. The correction pulse width $\Delta T(p, r)$ corresponding to the present rotational speed $N_e$ and the present intake air pressure $P_m$ is read-out from the corresponding address of the map stored in the non-volatile memory in the computer, an increment $\Delta t$ is added to or subtracted from the read-out correction pulse width, and the thus added or subtracted correction pulse width is written-in to the corresponding address of the memory.

When the existence of the relationship $N_{l-1} > N_{r-1} < N_l > N_r$ is not decided in Step S14, the process proceeds to Step S15. This is the case where the engine is running at a richer air-fuel ratio than that for optimum specific fuel consumption air-fuel ratio at one of the positions $M_1$ through $M_7$. In this case, the existence of the relationship $N_{l-1} < N_{r-1} > N_l < N_r$ is decided in Step S15, and the process proceeds to Step S16. In Step S16, the correction pulse width $\Delta T(p, r)$ corresponding to the state of the operation is reduced by $\Delta t$, and the resulting correction pulse width is stored in the memory. Thus, the amount of the fuel injection is decreased by the amount corresponding to the pulse width $\Delta t$ so that the amount of the fuel injection is brought to be close to the optimum amount.

When the existence of either the relationship $N_{l-1} > N_{r-1} < N_l > N_r$ or the relationship $N_{l-1} < N_{r-1}$-

$>N<N_r$ is not decided in Steps S14 and S15, the process proceeds to Step S17 where no amendment of $\Delta T(p, r)$ is carried out. This is the case, for example, where, when the state of the operation of the engine changes in the transient period of the engine, for example in the case of acceleration by actuating the accelerator, the change of the rotational speed due to acceleration is far greater than the change of the rotational speed due to the change of the air-fuel ratio by slightly varying the rate of air-flow in the rich and the lean steps, and the rotational speed is increased gradually. Accordingly, the relationship $N_{l-1}>N_{r-1}>N_l>N_r$ is established and hence the decisions in Steps S14 and S15 are NO and the process proceeds to Step 17. Also, when the air-fuel ratio is equal to the optimum specific fuel consumption air-fuel ratio, the relationship $N_{l-1}=N_{r-1}=N_l=N_r$ is established and no amendment of the correction of the pulse width is carried out so that the best fuel consumption air-fuel ratio tends to be maintained.

After steps S16, S17 and S18, the process proceeds to Step S19. In Step 19, the decision as to whether the present step is the rich step (X=0) or the lean step (X=1) is carried out. If it is the rich step (X=0), the decision is NO, and the process proceeds to Step S20, while if it is the lean step (X=1), the decision is YES, and the process proceeds to Step S1. When the process has proceeded from Step S1 through Step S13 as described above, the decision is NO, and the process proceeds to Step S20. In Step S20, the number Y of the injections is made zero. In this case, the process being in the lean step, the by-pass electromagnetic valve is made OPEN.

In Steps S22 through S24, similar calculations as in Steps S3 through S5 are carried out. In Step S25, the decision as to whether or not the opening of the throttle valve is greater than 60% is carried out. When the opening of the throttle valve is greater than 60%, the decision is YES, and the process proceeds to Step S35 where the by-path electromagnetic valve 13 is closed. In Step S36, the calculation of the pulse width for the running air-fuel ratio is carried out, and the adjustment to the optimum specific fuel consumption air-fuel ratio is interrupted. In Step S37, the signal with the calculated pulse width is supplied to the fuel injection valve 15. The process proceeds to Step S2 so that the entire process is started again.

When the decision in Step S25 is NO, the process proceeds to Step S26. In Step S26, the decision as to whether or not the throttle valve is in the fully-closed state is carried out. If the fully-closed state, the decision is YES, and the process proceeds to Step S38. In Step S38, the by-pass electromagnetic valve 13 is closed as in the case of Step S35. In Step S39, the calculation of the pulse width for the idling air-fuel ratio is carried out. In Step S40, the signal with the calculated pulse width is supplied to the fuel injection valve 15. The process proceeds to Step S2 so that the entire process is started again.

When the decision in Step S26 is NO, the process proceeds to Step S27. In Steps S27 through S29 similar calculations as in Steps S8 through S10 are carried out. In Step S30, the decision as to whether or not the number Y of the injections reaches the preselected number K is carried out. When the preselected number K is not reached, the decision is NO, and the process proceeds in the loop consisting of Steps S22 through S30.

When the number Y of the injections reaches K, the decision in Step S30 is YES, and the process proceeds to Step S31. In Step S31, the value of X is made one, in order to memorize that the present step is in the lean step. In Step S32, the rotational period $N_l$ of the lean step is stored in the memory as in the case of Step S13.

When the existence of the relationship $N_{r-1}<N_{l-1}>N_r<N_l$ is decided in Step S33, the process proceeds to S18 as in the case of S14. In Step S18, the amendment $\Delta t$ is added to the correction pulse width $\Delta T(p, r)$, and the amended correction pulse width is stored in the memory. When the existence of the relationship $N_{r-1}<N_{l-1}>N_r<N_l$ is not decided in Step S33, the process proceeds to Step S34. The decision as to whether or not the relationship $N_{r-1}>N_{l-1}<N_r>N_l$ is carried out in Step S34. When the existence of this relationship is decided in Step S34, the process proceeds to Step S16 where the amendment $\Delta t$ is subtracted from the correction pulse width $\Delta T(p, r)$ and the amended correction pulse width is stored in the memory. When the existence of this relationship is not decided in Step S34, the process proceeds to Step S17 and no amendment of the correction pulse width $\Delta T(p, r)$ is carried out.

After Steps S16, S17 and S18, the process proceeds to Step S19 where the decision as to whether or not the present step is the lean step is carried out. In this case, the Steps S20 through S32 are lean steps (X=1), the decision is YES, and the process proceeds to Step S1.

In accordance with the above described control of the engine, if the air-fuel is different from the air-fuel ratio corresponding to the best fuel consumption, the air-fuel ratio is corrected so that the air-fuel ratio corresponding to the best fuel consumption is attained. Also, it is possible to control the engine to realize always the optimum running condition, because the optimum correction value $\Delta T(p, r)$ corresponding to each state of the running of the engine is stored in the memory in the computer.

The relationship between the above described process of the calculation and the driving of the motor car in which the internal combustion engine in question is mounted will be explained with reference to FIG. 6. The movement of the operation position is started at $R_1$ of the rich step. The operation position moves from $R_1$ of the rich step to $L_1$ of the lean step along the curve identified by $F_1$. The position corresponding to the best fuel consumption on the curve identified by $F_1$ is $M_1$. The operation position moves from $L_1$ to $R_2$, then from $R_2$ to $L_2$. After the operation position has reached $L_2$, the existence of the relationship $N(R_1)>N(L_1)<N(R_2)>N(L_2)$ is decided in Step S34, and hence the reduction of the correction pulse width by $\Delta t$ is carried out in Step S16. Accordingly, the rate of the fuel flow is decreased so that the operation position moves from the curve $F_1$ to the position $R_3$ on the curve $F_2$, where the value $F_2$ is smaller than the value $F_1$. After the operation at the position $R_3$, the existence of the relationship $N(L_1)<N(R_2)>N(L_2)<N(R_3)$ is decided in Step 15, and accordingly the operation position moves from the curve $F_2$ to the curve $F_3$ where the value $F_3$ is smaller than the value $F_2$. In succession such movements of the operation position to the next curve take place until the operation position reaches $L_8$ where the relationship $N(R_5)>N(L_6)<N(R_7)<N(L_8)$ is established so that no further movement of operation position takes place.

Thus, the state of the running of the engine is led to the point $L_8$ which is quite close to the point $M_7$ corresponding to the best fuel consumption with a constant rate $F_7$ of the fuel flow. However, since at the beginning the driver of the motor car requires the rotational speed $N_{e1}$, the driver must become aware of the fall in the rotational speed from $N_{e1}$ to $N_{e2}$. When the driver becomes aware of this fall, he will actuate the accelerator to raise the rotational speed up to $N_{e1}$ so that the rate of fuel flow becomes the intermediate value between $F_4$ and $F_5$.

In the apparatus of FIG. 1, the rate of air flow through the by-pass electromagnetic valve 13 is selected from the viewpoint that both the drivability of the motor car in which the internal combustion engine is mounted and the ability of detection of the change of the rotational speed of the engine are satisfactory. The amendment value $\Delta t$ of the correction of the amount of the fuel injection is selected to be less than a half of the change of the air-fuel ratio caused by the action of the by-pass electromagnetic valve 13.

Although a specific embodiment of the present invention is described hereinbefore, various modifications are possible. For example, a set of decision conditions:

$N_{l-1} > N_{r-1}$, $N_l > N_r$ in Step S14,
$N_{l-1} < N_{r-1}$, $N_l < N_r$ in Step S15,
$N_{r-1} < N_{l-1}$, $N_r < N_l$ in Step S33, and
$N_{r-1} > N_{l-1}$, $N_r > N_l$ in Step S34 can be adopted in the flow chart of FIG. 3.

Also, instead of the ON-OFF type electromagnetic valve 13, an electromagnetic valve of the variable area type having a valve lift regulated by the electric current signal can be used, whereby the rate of the air-flow through the by-pass electromagnetic valve is controlled to be equal to a predetermined proportion of the rate of the air-flow through the air flow rate sensor 6.

Figure 7:
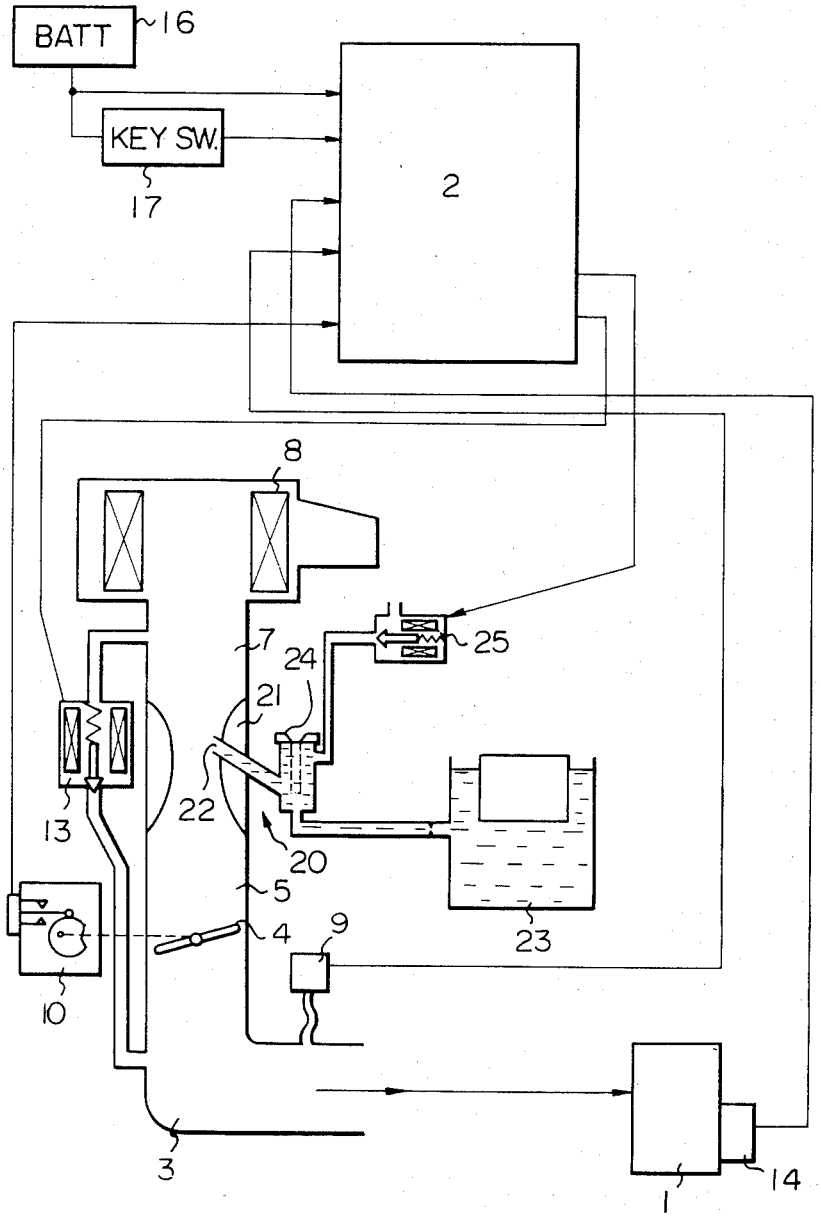
FIG. 7 illustrates an apparatus as another embodiment of the present invention.

An apparatus for controlling the air-fuel ratio in an internal combustion engine as another embodiment of the present invention is illustrated in FIG. 7. In the apparatus of FIG. 7, the fuel is supplied through the main nozzle 22 in the Venturi tube portion 21 of the carburetor 20 to which the fuel flows from the float chamber 23 via an air bleeding chamber 24. The air is led to the air bleeding chamber 24 through the second electromagnetic valve 25. The by-passing air flows through the first electromagnetic valve 13 in the by-pass of the carburetor 20. In the computer 2 similar calculation as in the case of FIG. 3 is carried out. The first electromagnetic valve 13 is controlled by the signals produced in the computer 2 as the result of the calculation. The regulation of the amount of the supplied fuel is carried out by varying the duty ratio of the signals with a predetermined frequency supplied to the second electromagnetic valve 25.

Also, in a modified embodiment of the present invention, by using two by-pass electromagnetic valves, three levels of the air-fuel ratio are prepared, i.e. the first level: "no by-passing" (RICH step (RS)), the second level: "one by-pass electromagnetic valves ON" (BASIC step (BS)), and the third level: "two by-pass electromagnetic valves ON" (LEAN step (LS)). The process of running of the engine changes in the following manner $B_1 \rightarrow R_2 \rightarrow B_3 \rightarrow L_4 \rightarrow B_5 \rightarrow R_6 \rightarrow B_7$. . . When the relationships $N(B_1)$, $N(B_3) > N(R_2)$ and $N(B_3)$, $N(B_5) < N(L_4)$ are established in five running points, the correction pulse width $\Delta T(p, r)$ is adjusted by adding the value $\Delta t$, while when the relationships $N(B_1)$, $N(B_3) < N(R_2)$ and $N(B_3)$, $N(B_5) > N(L_4)$ are established in five running points, the correction pulse width $\Delta T(p, r)$ is adjusted by subtracting the value $\Delta t$.

We claim:

1. A method for controlling the air-fuel ratio in an internal combustion engine, which comprises the steps of:

obtaining the base air-fuel ratio determined by a base fuel amount and a base intake air amount, detecting the signal which represents the rotation rate of the engine in operation, selecting the air-fuel ratio at the richer side of the base air-fuel ratio and the air-fuel ratio at the leaner side of the base air-fuel ratio in the vicinity of the base air-fuel ratio, by regulating the rate of the air flow in a by-pass for the main air path in the engine, said air flow in said by-pass being supplied to the downstream of a throttle valve, driving the engine using an air-fuel mixture with said selected at least two air-fuel ratios in the richer and the leaner side during predetermined periods, detecting the signals which represent the engine status while the engine is running with the richer side air-fuel ratio and the engine status while the engine is running with the leaner side air-fuel ratio, storing the detected signals which represent the engine statuses, comparing four signals representing four engine statuses detected during four running periods including two running periods with the richer side air-fuel ratio and two running periods with the leaner side air-fuel ratio, determining, based on the result of said comparison, whether the air-fuel ratio is the value in the richer or the leaner side of the air-fuel ratio corresponding to the maximum specific fuel consumption, and correcting the base air-fuel ratio by changing the base fuel injection amount, based on the result of said determination, so as to become closer to the air-fuel ratio corresponding to the best specific fuel consumption.

2. A method according to claim 1, wherein the control of the air-fuel ratio is performed by changing the amount of the fuel injection.

3. A method according to claim 1, wherein the control of the air-fuel ratio is performed by regulating the rate of the by-passing air flow through an electromagnetic valve in a by-pass for the main air path.

4. A method for controlling the air-fuel ratio of a running internal combustion engine having an air intake passage containing a throttle valve for controlling the amount of intake air flowing to the engine and a bypass passage for delivering a flow of bypass air to the air intake passage downstream of the throttle valve, the method comprising:

supplying a base fuel amount to the running engine in accordance with the amount of intake air to obtain a predetermined base air-fuel ratio;

producing a signal which represents the rotation rate of the engine;

delivering a dithered flow of bypass air to the intake passage downstream of the throttle valve to produce at least two selected air-fuel ratios in a range between relatively richer and relatively lea ner air-fuel ratio values in the vicinity of the base air-fuel ratio;

detecting the signals which represent the ro tation rates of the engine during successive periods of running at said at least two different selected air-fuel ratios;

storing said detected signals;

comparing said stored signals representing engine rotation rates during at least three running periods, including first and third running periods at a first one of said selected air-fuel ratios and an intermediate second running period at a second one of said selected air-fuel ratios;

determining, based on the result of said comparison, whenever the engine rotation rate during said second running period is either greater than or less than the engine rotation rates during both of said first and third running periods; and changing the base fuel amount supplied to the engine, in response to such a determination, to correct the base air-fuel ratio so as to become closer to the air-fuel ratio corresponding to an optimum specific fuel consumption for the engine.

5. A method for controlling the air-fuel ratio of a running internal combustion engine according to claim 4, wherein said step of changing the amount of fuel comprises:

changing the base fuel amount supplied to the engine to correct the base air-fuel ration in the relative direction of the first selected air-fuel ratio whenever the engine rotation rate during said second running period is less than the engine rotation rates during both of said first and third running periods, and to correct the base air-fuel ratio in the relative direction of the second selected air-fuel ratio whenever the engine rotation rate during said second running period is greater than the engine rotation rates during both of the first and third running periods.

6. A method for controlling the air-fuel ratio of a running internal combustion engine according to claim 4, wherein the step of supplying a base fuel amount to the engine comprises injecting a base fuel pulse for each ignition, and the step of changing the base fuel amount supplied to the engine comprises changing the amount of each base fuel injection pulse.

7. A method for controlling the air-fuel ratio of a running internal internal combustion engine according to claim 4, wherein the step of supplying a base fuel amount to the engine comprises delivering fuel via a jet in a venturi carburetor, and the step of changing the base fuel amount supplied to the engine comprises regulating the rate of a flow of bleed air through an air bleeding chamber in the fuel path to said jet.

8. A method for controlling the air-fuel ratio of a running internal combustion engine according to claim 4, wherein the step of delivering a dithered flow of bypass air comprises alternately actuating and deactuating an electromagnetic valve in said bypass passage.

9. A method for controlling the air-fuel ratio in a running internal combustion engine according to claim 4, wherein the step of comparing said stored signals representing engine rotation rates comprises comparing signals for first and third running periods at a first selected air-fuel ratio and second and fourth running periods, following the respective first and third running periods, at a second selected air-fuel ratio.

10. A method for controlling the air-fuel ratio of a running internal combustion engine according to claim 9, wherein said step of determining whenever the engine rotation rate during said second running period is either greater than or less than the engine rotation rates during both of the first and third running periods further comprises determining whether the engine rotation rate during the fourth running period is greater than the engine rotation rate during the third running period when the engine rotation rate for the second running period is greater than the engine rotation rates for both the first and third running periods and whether the engine rotation rate for the fourth running period is less than the engine rotation rate for the third running period when the engine rotation rate for the second running period is less than the engine rotation rates for both of the first and third running periods.

11. A method for controlling the air-fuel ratio of a running internal combustion engine according to claim 4, wherein one of said at least two selected air-fuel ratios is the base air-fuel ratio.

12. A method for controlling the air-fuel ratio of a running internal combustion engine according to claim 11, wherein said selected air-fuel ratios include an air-fuel ratio richer than the base air-fuel ratio and an air-fuel ratio leaner than the base air-fuel ratio.

13. A method for controlling the air-fuel ratio of a running internal combustion engine according to claim 12, wherein said step of comparing said stored signals comprises comparing signals from five running periods including three running periods at the base air-fuel ratio, a running period at said richer air-fuel ratio occurring between two of the running periods at the base air-fuel ratio and a running period at the leaner air-fuel ratio occurring between another two of the running periods at the base air-fuel ratio.

14. An apparatus for controlling the air-fuel ratio in an internal combustion engine having an air intake passage, a throttle valve disposed in the air intake passage for controlling the amount of intake air flow to the engine, means for supplying fuel to the engine, and a bypass air passage having an outlet connected to the air intake passage downstream of the throttle valve, wherein the apparatus comprises:

means for controlling the fuel supplying means in accordance with the amount of intake air flow to obtain a predetermined base air-fuel ratio;

a sensor for detecting rotation angles of the engine;

means for shutting and for opening the bypass passage by at least a first selected amount for predetermined periods for supplying selectively alternating flow of bypass air to the intake passage downstream of the throttle valve;

a computer responsive to signals from said rotation angle sensor for controlling the means for shutting and opening the bypass passage to obtain for successive predetermined running periods at least two different selected air-fuel ratios in a range between relatively richer and relatively leaner air-fuel ratio values in the vicinity of said base air-fuel ratio, for comparing signals representing engine rotation rate during at least three running periods, including first and third running periods at a first one of said selected air-fuel ratios and an intermediate second running period at a second one of said selected air-fuel ratios, and for determining from said comparison whenever the engine rotation rate during said second running period is either greater than or less than the engine rotation rates during both of the first and third running periods, and for generating a correction signal in response to each such determination for correcting the base fuel amount so as to make the base air-fuel ratio closer to the air-fuel ratio corresponding to an optimum specific fuel consumption for the engine; and means for delivering the correction signal from the computer to said means for controlling the fuel supply means.

15. An apparatus according to claim 14, wherein said computer compares said signals representing engine rotation rate for four running periods, including first and third running periods at a first one of said selected air-fuel ratios and second and fourth running periods, following the respective first and third running periods, at a second one of said selected air-fuel ratios.

* * * * *

UNITED STATES PATENT AND TRADEMARK OFFICE

CERTIFICATE OF CORRECTION

PATENT NO. : 4,503,824

DATED : March 12, 1985

INVENTOR(S) : M. Ninomiya et al.

It is certified that error appears in the above-identified patent and that said Letters Patent is hereby corrected as shown below:

Column 1, line 65, change > to < .

Column 1, line 68, after "determine" add --as to-- before "whether".

Column 2, line 14, after "with" add --the necessary-- before "high".

Column 2, line 17, change "enging" to --engine--.

Column 2, line 46, change "the maxi-" to --the best--.

Column 2, line 47, delete "mum specific".

Column 3, line 36, change "of the" to --of an--.

Column 3, line 52, change "13 and" to --13, and--.

UNITED STATES PATENT AND TRADEMARK OFFICE

CERTIFICATE OF CORRECTION

PATENT NO. : 4,503,824

DATED : March 12, 1985

INVENTOR(S) : M. Ninomiya et al.

It is certified that error appears in the above-identified patent and that said Letters Patent is hereby corrected as shown below:

Column 4, line 67, after "equation" add --:--.

Column 5, line 67, eliminate the spaces between each word in that line.

Column 6, line 56, delete "air-fuel ratio".

Column 7, line 41, change "by-path" to --by-pass--.

Column 8, line 52, eliminate the spaces between each word in that line.

Column 10, line 9, change "signal" to --signals--.

Column 10, line 64, change "lea ner" to --leaner--.

Column 10, line 67, change "ro tation" to --rotation--.

Signed and Sealed this

*Twenty-ninth* Day of *October 1985*

[SEAL]

*Attest:*

*Attesting Officer*

DONALD J. QUIGG

*Commissioner of Patents and Trademarks—Designate*